US008279083B2

(12) United States Patent
Tengler et al.

(10) Patent No.: US 8,279,083 B2
(45) **Date of Patent: *Oct. 2, 2012**

(54) VEHICLE INFORMATION COMMUNICATION METHOD

(75) Inventors: Steve Tengler, Grosse Pointe Park, MI (US); Ronald Heft, Canton, MI (US)

(73) Assignee: Nissan Motor Co., Ltd., Kanagawa (JP)

( * ) Notice: Subject to any disclaimer, the term of this patent is extended or adjusted under 35 U.S.C. 154(b) by 349 days.

This patent is subject to a terminal disclaimer.

(21) Appl. No.: 12/574,817

(22) Filed: Oct. 7, 2009

(65) Prior Publication Data

US 2010/0045481 A1 Feb. 25, 2010

Related U.S. Application Data

(63) Continuation of application No. 11/637,187, filed on Dec. 12, 2006, now Pat. No. 7,609,174.

(51) Int. Cl.
*G08G 1/00* (2006.01)

(52) U.S. Cl. ..... 340/902; 340/904; 340/905

(58) Field of Classification Search ..... None
See application file for complete search history.

(56) References Cited

U.S. PATENT DOCUMENTS 4,490,717 A * 12/1984 Saito ..... 340/996
4,754,428 A 6/1988 Schultz et al.
4,821,292 A * 4/1989 Childress ..... 375/319
4,882,765 A * 11/1989 Maxwell et al. ..... 455/18
6,097,313 A 8/2000 Takahashi et al.
6,490,519 B1 12/2002 Lapidot et al.
6,870,487 B2 3/2005 Nuesser et al.
6,985,089 B2 * 1/2006 Liu et al. ..... 340/903
7,046,168 B2 5/2006 Tsuboi
7,702,739 B1 * 4/2010 Cheng et al. ..... 709/207
2001/0054098 A1 * 12/2001 Lee ..... 709/224
2003/0146850 A1 8/2003 Fallenstein
2003/0187571 A1 10/2003 Impson et al.
2005/0156756 A1 7/2005 Fujita et al.
2005/0221759 A1 * 10/2005 Spadafora et al. ..... 455/41.2
2008/0186206 A1 * 8/2008 Reumerman ..... 340/902

OTHER PUBLICATIONS

William Whyte, Safe at Any Speed: Dedicated Short Range Communications (DSRC) and On-road Safety and Security, Feb. 15, 2005, NTRU Cryptosystems, RSA Conference 2005, 49-50.

* cited by examiner

*Primary Examiner* — Jennifer Mehmood
*Assistant Examiner* — Brian Wilson
(74) *Attorney, Agent, or Firm* — Global IP Counselors, LLP

(57) ABSTRACT

A vehicle information communication method is provided in which at least one of host vehicle probe data and surrounding vehicle probe data is collected in a host vehicle. After collection, the data is transmitted to a carrier vehicle. The carrier vehicle then disassociates identifying information from the data before sending the data to an external communication device.

28 Claims, 5 Drawing Sheets

VEHICLE INFORMATION COMMUNICATION METHOD

CROSS-REFERENCE TO RELATED APPLICATIONS

This application is a continuation application of U.S. patent application Ser. No. 11/637,187 filed on Dec. 12, 2006. The entire disclosure of U.S. patent application Ser. No. 11/637,187 is hereby incorporated herein by reference.

BACKGROUND OF THE INVENTION

1. Field of the Invention

The present invention generally relates to collection of non-safety data such as vehicle probe data from vehicles. More specifically, the present invention relates to a vehicle information communication method in which identifying information is disassociated from vehicle probe data before being collected by an external source.

2. Background Information

Recently, vehicles are being equipped with a variety of informational systems such as navigation systems, Sirius and XM satellite radio systems, two-way satellite services, built-in cell phones, DVD players and the like. These systems are sometimes interconnected for increased functionality. Various informational systems have been proposed that use wireless communications between vehicles and between infrastructures, such as roadside units. These wireless communications have a wide range of applications ranging from crash avoidance to entertainment systems. The type of wireless communications to be used depends on the particular application. Some examples of wireless technologies that are currently available include digital cellular systems, Bluetooth systems, wireless LAN systems and dedicated short range communications (DSRC) systems.

Dedicated short range communications (DSRC) is an emerging technology that has been recently investigated for suitability in vehicles for a wide range of applications including safety and non-safety applications. DSRC technology will allow vehicles to communicate directly with other vehicles and with roadside units to exchange a wide range of information. In the United States, DSRC technology will use a high frequency radio transmission (5.9 GHz) that offers the potential to effectively support wireless data communications between vehicles, and between vehicles, roadside units and other infrastructures. The important feature of DSRC technology is that the latency time between communications is very low compared to most other technologies that are currently available. Another important feature of DSRC technology is the capability of conducting both point-to-point wireless communications and broadcast wireless messages in a limited broadcast area.

Typically, this type of communications occurs between moving vehicles entering a communications zone with fixed roadside communication equipment or directly between moving vehicles. The wireless technology provides the foundation for a variety of applications including vehicle safety, emergency vehicle notification, automated tolling, enhanced navigation, traffic management and many others. Accordingly, wireless technology can be used to provide various information from vehicle-to/from-infrastructure, and from vehicle-to-vehicle, such as providing GPS location, vehicle speed and other vehicle Parameter Identifiers (PIDs) including engine speed, engine run time, engine coolant temperature, barometric pressure, etc. When communications are established with between vehicles and/or roadside units in close proximity, this information would be communicated to provide a complete understanding of the vehicles in the broadcast area. This information then can be used by the vehicles for both vehicle safety applications and non-safety applications.

Recently, the automotive industry and various government agencies have been involved in a coordinated effort to develop a roadway communications infrastructure that collects information from vehicles. Since many vehicles are already equipped with a Global Positioning System (GPS) as well as a large array of sensors that are necessary for operating and maintaining the vehicle, this data is already available on many of the vehicles without any modifications other than a wireless communications system such as DSRC. This data, when coupled with additional information provided by GPS (vehicle's position, speed, acceleration and direction) would be an invaluable resource to assist in the development, maintenance and planning of roadways and transportation systems. This type of data to be collected by vehicles is called "probe data."

In safety-related applications, a "Common Message Set" (CMS) will likely be broadcast by each vehicle giving a temporary ID ("MAC address"), relevant kinematical and location information such as GPS/Vehicle Position, velocity, vehicular dimensions, throttle position, etc. For a crash avoidance system, a vehicle would analyze the provided information, determine if a crash was imminent, send a confirmation note to the other vehicle, and quickly exchange all the information to confirm and mitigate the incident before crashing. Once the accident seems likely, the system will respond with an appropriate countermeasure, e.g., pre-tensioning the seatbelts, pre-arming the airbags, vibrating the seat, producing a visual/auditory alert, deploying an external airbag, aligning bumper heights, etc.

However, in non-safety-related applications, specifically collecting probe vehicle information of road segments, speed, weather information, etc., the temporary ID ("MAC address") may be stored with the probe data such that the various information about a driver can be available to other individuals. This collection of probe data (private information) could raise privacy concerns ("Big Brother tracking me"). In other words, there might be an uproar by the customers against the collection of probe data.

Multiple strategies have been proposed to solve this privacy problem in collecting probe data. One particular strategy is to randomize the MAC address. However, randomizing the MAC address fault may result in inaccurate predictions when such an identifier must be stable. For example, if a pre-crash condition is about to occur, changing a vehicle's information could have serious consequences. The crashing vehicle will be attempting to reach the old address to no avail, and must await discovery and re-authentication of the newly randomized vehicle prior to communicating the same, urgent message. Given that such an external event cannot be predicted, randomized the MAC address is not a preferred solution.

In view of the above, it will be apparent to those skilled in the art from this disclosure that there exists a need for an improved vehicle information communication system. This invention addresses this need in the art as well as other needs, which will become apparent to those skilled in the art from this disclosure.

SUMMARY OF THE INVENTION

One object of the present invention is to provide a vehicle information communication method in which probe data or other private data relating to a vehicle can be collected with anonymity.

Another object of the present invention is to provide a vehicle information communication method in which the vehicle's identifying information (e.g., MAC address) becomes disassociated with its probe data or other private data that is being collected without randomizing the vehicle's identifying information (e.g., MAC address).

In accordance with one aspect of the present invention, a vehicle information communication method is provided that comprises first collecting at least one of host vehicle probe data and surrounding vehicle probe data in a host vehicle. The at least one of the host vehicle probe data and the surrounding vehicle probe data is then transmitted from the host vehicle to a carrier vehicle. Subsequently, identifying information is disassociated from the at least one of the host vehicle probe data and the surrounding vehicle probe data. Finally, the at least one of the host vehicle probe data and the surrounding vehicle probe data is transmitted from the carrier vehicle to an external communication device when the carrier vehicle is within a communication area of the external communication device.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
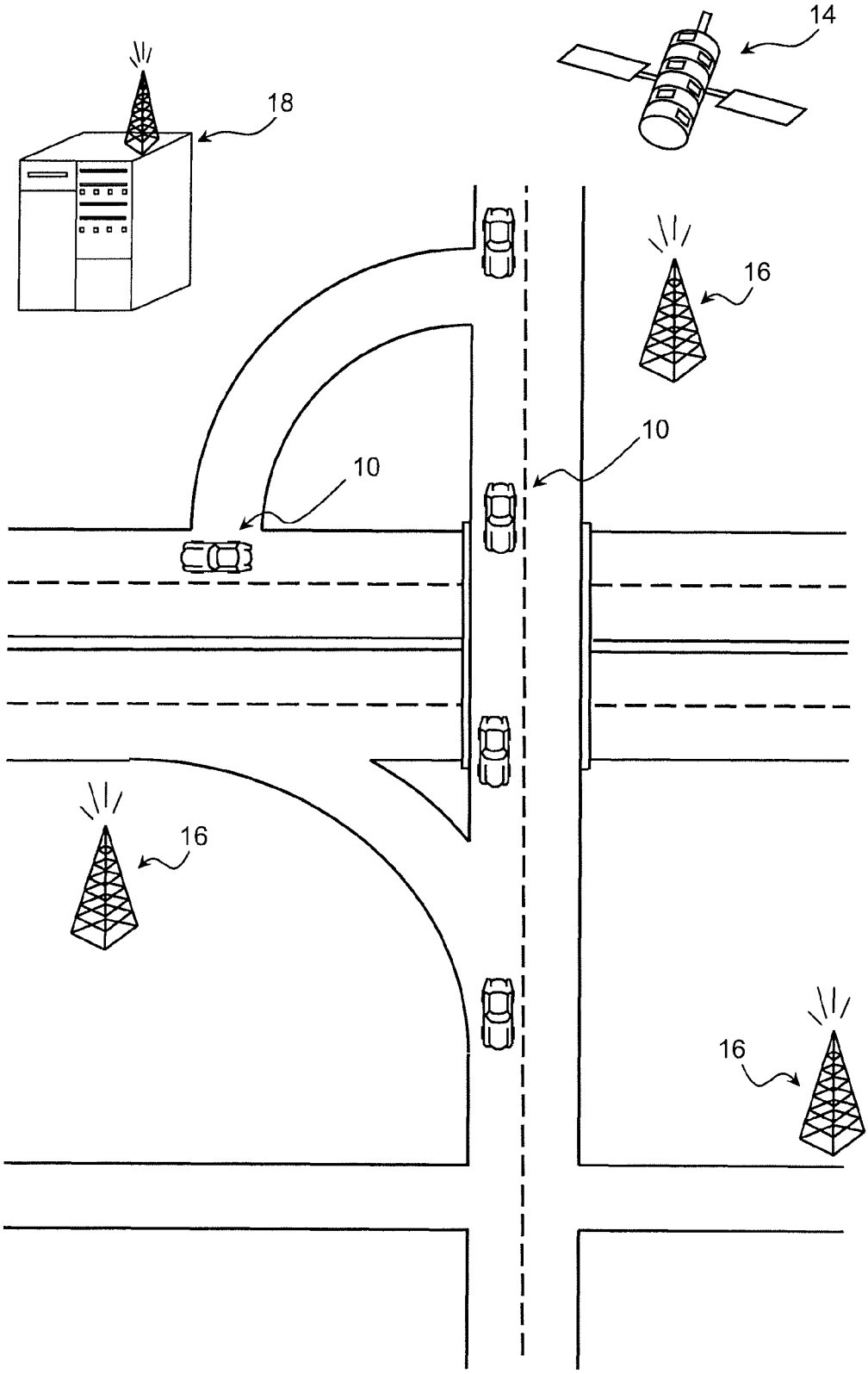
FIG. 1 is a pictorial representation of a two-way wireless communications network showing several vehicles equipped with an on-board unit capable of conducting two-way wireless communications with each other and as well as an external server via a plurality of roadside units in a vehicle infrastructure system in accordance with the present invention.
Figure 2:
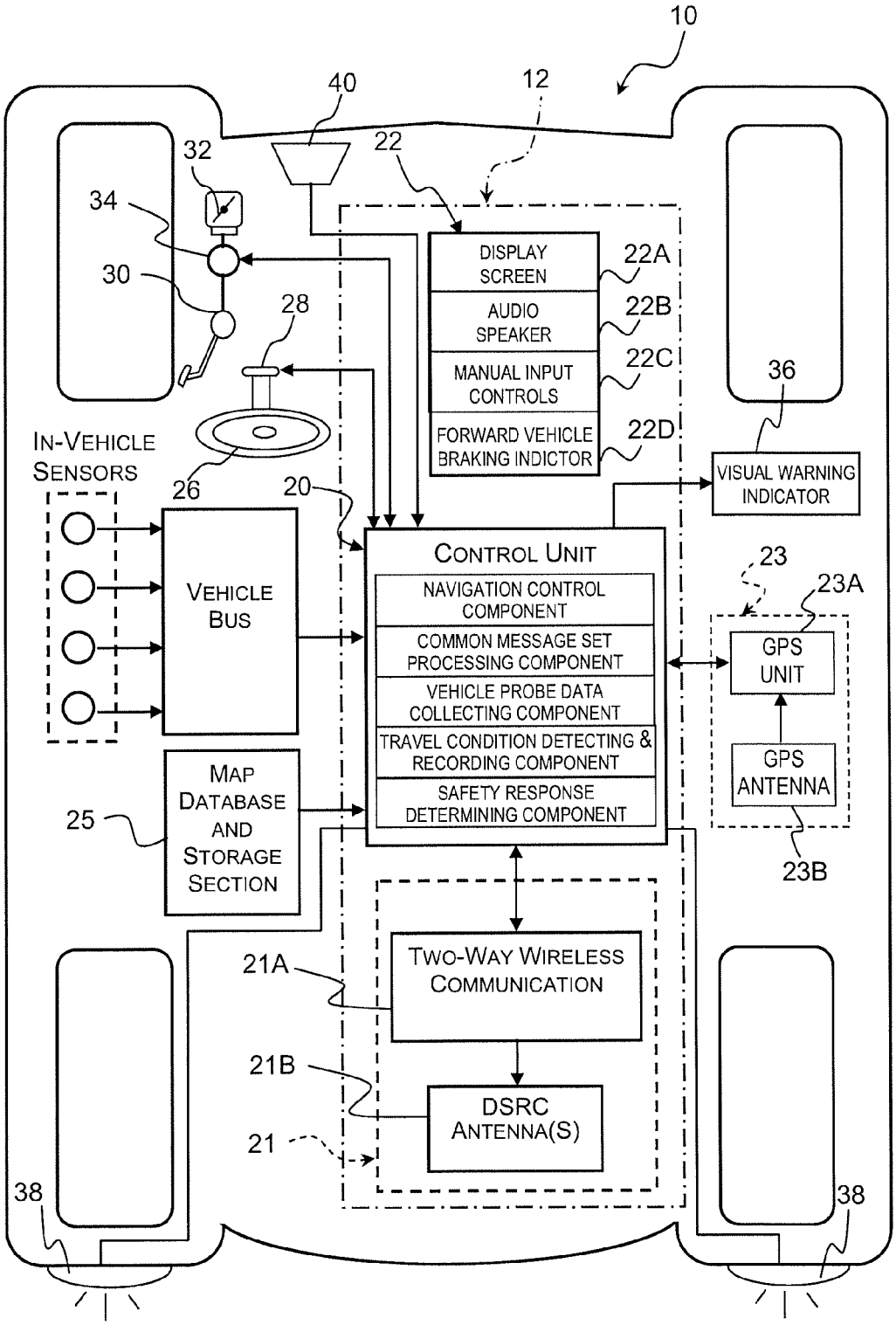
FIG. 2 is a schematic representation of a vehicle that is equipped with the on-board unit for conducting two-way wireless communications in the vehicle infrastructure system in accordance with the present invention.
Figure 3:
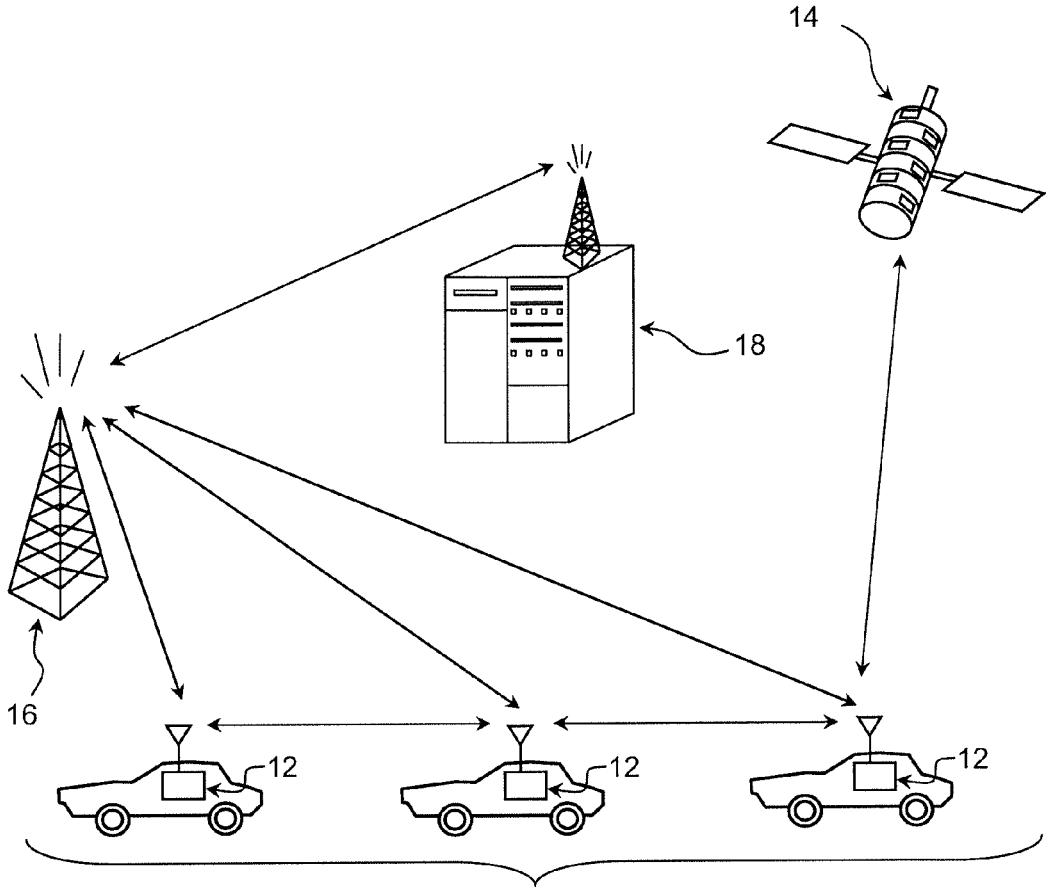
FIG. 3 is a pictorial representation of the two-way wireless communications network showing the various communications in the vehicle infrastructure system in accordance with the present invention.
Figure 4:
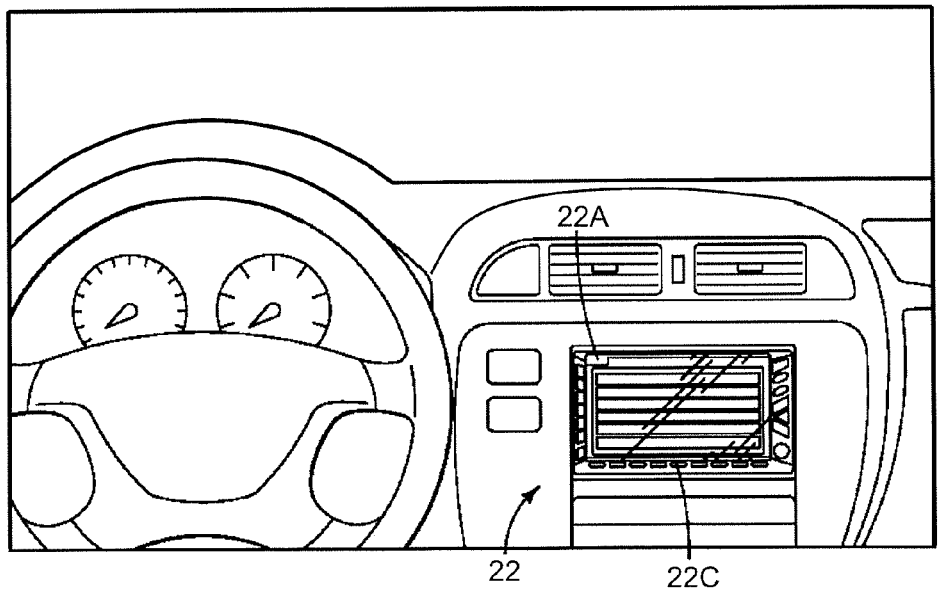
FIG. 4 is an inside elevational view of a portion of the vehicle's interior that is equipped with the on-board unit for conducting two-way wireless communications in the vehicle navigation system in accordance with the present invention.

Referring initially to FIGS. 1 to 3, a two-way wireless communications network is illustrated that forms a part of a vehicle infrastructure system in accordance with one embodiment of the present invention. In this vehicle infrastructure system, a plurality of host vehicles 10 are each equipped with a vehicle on-board unit (OBU) 12 in accordance with one embodiment of the present invention. The two-way wireless communications network also preferably includes one or more global positioning satellites 14 (only one shown), and one or more roadside units (RSU) 16 and a base station or external server 18. The satellites 14, the roadside units 16 and the base station 18 constitute that external communication device can receive data from the vehicle on-board units 12 of the host vehicles 10. The vehicle on-board units 12 are configured to perform both safety and non-safety application. The present invention is basically directed to the communication of host vehicle information or data to an external communication device such as the satellites 14, the roadside units 16 and the base station 18, while protecting the privacy of the host vehicle 10.

In this system, the term "host vehicle" refers to a vehicle among a group of vehicles equipped with two-way wireless communications in which vehicle to vehicle communications and vehicle to roadside units are carried out in accordance with the present invention. The terms "surrounding vehicle", "neighboring vehicle" and "nearby vehicle" refer to vehicles equipped with two-way wireless communications that are located within a prescribed communication (broadcasting/receiving) area surrounding the host vehicle in which the host vehicle is capable of either broadcasting a signal to another vehicle within a certain range and/or receiving a signal from another vehicle within a certain range.

As explained below in more detail, the vehicle on-board units 12 of the host vehicles 10 are configured and arranged to collect and record various information about environmental traveling conditions of the host vehicle. These environmental traveling conditions of the host vehicle are referred to herein as "host vehicle probe data" or just "probe data" that is used for various non-safety applications. The probe data is generally comprised of vehicle attribute and sensor data that is collected in the host (probe) vehicle and then sent to a carrier vehicle, which sends the collected data to a nearby one of the roadside units 16. For example, the probe data preferably includes data, indicating vehicle type, route segment identity, time and location, traffic conditions, road conditions, weather conditions and operational status of the host vehicle's equipment. Also the probe data will include a MAC address or some other identifying information of the host vehicle that is sent with the probe data. As explained below, the data will be collected autonomously as vehicles are traveling along the roadway system and sent to the roadside units 16, when applicable, by using a carrier vehicle to disassociate the MAC address of the host (probe) vehicle from the probe data. The standard for the type of data to be included in the probe data can be set in advance in the vehicle on-board unit (OBU) 12 or communicated to the host vehicle 10 when the vehicle is started up. The probe data is used to exchange status about a vehicle and its surrounding environmental conditions with the roadside units 16 to allow the collection of information about typical vehicle traveling behaviors and conditions along a segment of road. In typical use the host (probe) vehicle has collected one or more snapshots which it will send to the roadside units 16 via a carrier vehicle along with information (the vector) about the point in time and space when the snapshot event occurred. This probe data will be used to ascertain real time road, weather, and traffic conditions as well as provide other information for transportation planning. The post-processed data can be used to advise vehicles approaching the area of current conditions and suggest appropriate action.

In other words, the probe data message includes a series of probe data snapshots taken as the vehicle travels. These snapshots contain all probe data elements that are available on the vehicle along with the time and location when each snapshot was taken. In one example, each snapshot contains a "number of vehicle device status fields" such as (1) a data element field that identifies how many data elements are contained in a snapshot, (2) a type field that identifies the type of element (Wipers, Anti-Lock Brakes, etc) and (3) a value field that contains the data relating to that element for this particular snapshot (10 swipes per minute, Not Active).

As a default, probe data snapshots are taken either based on elapsed time since the last snapshot (i.e. snapshots at selected intervals) or based on an event trigger. For time driven snapshots, the faster the vehicle is traveling the longer the interval between snapshots. Time driven snapshots can be taken, for example, every 20 seconds while the vehicle is traveling at 60 Mph or faster and changes linearly to every 6 seconds when the vehicle is traveling 20 Mph and slower. A probe data trigger event can be when one or more probe data elements, defined as triggers, change states or exceeds a specified threshold. For example the anti-lock brake status can be defined as a probe data event trigger. When the anti-lock brake system engages, a probe data snapshot can be taken. Also when the vehicle speed falls below a threshold speed level can be treated as triggered event since it could imply a traffic backup and provide an indication of the travel time of a particular roadway link, among other things.

In accordance with the present invention, upon recognition of the end of a segment of collected data, the host vehicle 10 would broadcast its MAC address and a search for a carrier vehicle. Upon hearing such a request, the carrier vehicle would respond with a unicast (i.e. "one speaker-one receiver") message to the host vehicle's MAC address stating it is available for such an assignment and provide its own MAC address. The host vehicle 10 would then pick the first such response it gets, and send its probe data to the carrier vehicle. After the carrier vehicle acknowledges receipt of the full packet, the host vehicle 10 will erase its probe data from its internal storage. Meanwhile, the carrier vehicle shall proceed to the next roadside unit 16 and deliver the probe data with its own MAC address. In particular, when the carrier vehicle encounters the next roadside unit 16, its on board unit will send the probe data message set, comprised of several individual messages, on the service channel indicated by the roadside unit 16. By doing this, the delivered probe information has been disassociated from the carrier vehicle, traceability cannot be accomplished, and the information need not be truncated or withheld. When the roadside unit 16 receives the probe data it will send the data to the base station 18.

Referring now to FIG. 2, the vehicle on-board unit 12 of the present invention basically includes a controller or control unit 20, a two-way wireless communication system 21 and a human-machine interface section 22. In the present invention, the control unit 20 and the human-machine interface section 22 cooperate together to constitute both a user inputting section and a reporting section. Also in the present invention, the control unit 20 and the two-way wireless communication system 21 cooperate together to constitute a vehicle to vehicle communication section.

The two-way wireless communication system 21 is configured and arranged such that the control unit 20 receives and/or sends various signals to other DSRC equipped component and systems in the communication (broadcasting/receiving) area that surrounds the host vehicle 10. The human-machine interface section 22 includes a screen display 22A, an audio speaker 22B and a plurality of manual input controls 22C that are operatively coupled to the control unit 20. The control unit 20 is also preferably coupled to a global positioning system 23 (constituting a navigation unit) having a GPS unit 23A and a GPS antenna 23B. Thus, the control unit 20 and the global positioning system 23 (constituting a navigation system or unit) function together as a travel route recording section that is configured to record travel route data (e.g., a starting point, an ending point and a travel time) that is transmitted by the vehicle communication section. Preferably, the travel route recording section, which is preferably part of a navigation system, records the starting point in response to selection of a destination. A map database and storage section 25 is also preferably provided that contains various data used by the control unit 20 to carry out the navigation controls as well as implementation of various safety measures. The map database and storage section 25 can be manual updated through removable media (CD-ROM or DVD) or automatically updated via periodic communications with the base station 18. The control unit 20, the human-machine interface section 22, the global positioning system 23 and the map database and storage section 25 are operatively connected together to perform the various navigation functions, and thus, constitute an on-board navigation unit. Moreover, the control unit 20 of the vehicle on-board unit 12 is configured to receive detection signals from various in-vehicle sensors including, but not limited to, an ignition switch sensor, an accessory switch sensor, a vehicle speed sensor, an acceleration sensor, etc.

Still referring now to FIG. 2, the vehicle 10 is basically a conventional vehicle which has been modified to incorporate the vehicle on-board unit 12 of the present invention. Thus, the conventional parts of the vehicle 10 will not be discussed and/or illustrated herein. Rather, only those parts that interact with the vehicle on-board unit 12 will be discussed and/or illustrated herein as needed to understand the present invention. The vehicle 10 is also provided with various sensors or detection devices for collecting the probe data. For example, a steering structure 26 is provided with a steering sensor 28 providing steering data to the control unit 20. An accelerator pedal 30 is operatively connected to a throttle valve 32 with an accelerator pedal sensor 34 providing accelerator pedal operation data to the control unit 20. A visual warning indicator 36 and a pair of brake lights 38 are provided with sensors for providing data to the control unit 20. The sensors of the visual warning indicator 36 and the brake lights 38 are included in the in-vehicle sensors shown in FIG. 2. A camera 40 is provided for supplying images to the control unit 20. Preferably, the in-vehicle sensors shown in FIG. 2 also include a rain sensor and/or a wiper sensor for supplying weather data to the control unit 20. Of course, other sensors or detection devices as well as other parts not shown can be provided as needed and/or desired. Theses detection devices and other in vehicle sensors are operatively monitored and/or controlled by the control unit 20 to record various running conditions of the vehicle and various traveling (external environmental) conditions.

Still referring to FIG. 2, the control unit 20 is operatively connected to the two-way wireless communication system 21, the human-machine interface section 22, the global positioning system 23, the map database and storage section 25, the throttle valve opening sensor 34, and the visual warning indicator 36. The control programs of the control unit 20 are programmed to include functions that can be generally divided into a navigation control component, a common message set processing component, a vehicle probe data collecting component, a travel condition detecting and recording component and a safety response determining component. The navigation control component is configured to control the navigation functions of the navigation unit. The navigation functions are conventional, and thus, the navigation basic functions will not be discussed herein. However, the navigation control component can be used to select optional (opt-in) services that will collect and record other selected vehicle data such as Origin-Destination data in the same manner as the basic probe data. Thus, in addition to basic probe data, an opt-in service might allow various third parties to obtain other private data such as Origin-Destination data. In this scenario, the user would key-on the vehicle, select a destination via the navigation unit, and select that user is willing to provide Origin-Destination data. Upon requesting and discovering the first carrier vehicle, the stored Origin-Destination data would also be transferred and subsequently erased from onboard memory. Once again, this disassociates the identifying information (MAC address) from the privacy-laden information (e.g. home address, work location, speeds along the way). While the navigation unit is illustrated for selecting the option of providing the Origin-Destination data, it will be apparent that this can be done in vehicles without a navigation unit.

The common message set processing component is configured to process the signals from the various vehicle sensors to produce the outgoing common message set, and to process the incoming common message sets from other vehicles 10 and/or roadside units 16. In particular, the two-way wireless communication system 21 is operatively connected to the common message set processing component to provide the incoming messages from neighboring vehicle to the common message set processing component of the control unit 20.

The travel condition detecting and recording component is configured to process the various signals relating to the current traveling condition of the host vehicle and/or neighboring vehicles. The vehicle traveling condition detecting component of the control unit 20 receives various signals from the vehicle sensors that indicate a current vehicle traveling condition of the host vehicle. Thus, the vehicle traveling condition detecting component of the control unit 20 functions as a vehicle traveling condition detecting section that determines a current vehicle traveling condition of the host vehicle.

The safety response determining component is configured to activate the various warning devices and/or countermeasure devices upon detecting a potential safety concern to the host vehicle.

As seen in FIG. 3, the two-way wireless communications are conducted between the vehicles 10 as well as between the vehicles 10 and the roadside units 16. The base station 18 is configured and arranged to communicate with the vehicle on-board unit 12 to provide the off-board navigation service through wireless communications via the roadside units 16 within the two-way wireless communications network, if need and/or desired. In particular, the roadside units 16 (only two shown) relay signals between the vehicle on-board units 12 of the host vehicles 10 and the base station 18. Thus, the roadside units 16 are configured to send signals to the base station 18 and the vehicle on-board units 12 of the host vehicles 10, and receive signals from the vehicle on-board units 12 of the host vehicles 10 and the base station 18. While the two-way wireless communications network is illustrated as a dedicated short range communications (DSRC) network, it will be apparent to those skilled in the art from this disclosure that other types of two-way wireless communications networks can be used to carry out the present invention. For example, it will be apparent to those skilled in the art from this disclosure that two-way communications such as cellular, Wimax, Wifi, etc can be used as a two-way wireless communications network to carry out the present invention. However, preferably, the roadside units 16 include a DSRC device that is used to transmit data to, and receive data from, DSRC equipped moving vehicles. The roadside units 16 transmits from a fixed position on the roadside (which may in fact be a permanent installation or from "temporary" equipment brought on-site for a period of time associated with an incident, road construction, or other event). The roadside units 16 have the ability to transmit signals with greater power than the vehicles 10 and can have TCIP/IP connectivity to other nodes or the Internet. Thus, the base station 18 can communicate via the Internet.

The global positioning satellite 14 is a conventional component that is known in the art. Since the global positioning satellite is known in the art, the structures of the global positioning satellite 14 will not be discussed or illustrated in detail herein. Rather, it will be apparent to those skilled in the art from this disclosure that the global positioning satellite 14 can be any type of structure that can be used to carry out the present invention.

The host vehicles 10 are preferably each equipped with a travel data recording and collection unit so that information can be communicated between the vehicles 10 and the nearby roadside units 16 within the two-way wireless communications network. More specifically, each of the roadside units 16 is equipped with a DSRC unit or other suitable two-way wireless communication system for broadcasting and receiving signals to/from the host vehicles 10 located within a prescribed communication (broadcasting/receiving) region surrounding the roadside unit 16. Moreover, each roadside unit 16 is preferably an IP enabled infrastructure that is configured and arranged to establish a link between the vehicle on-board unit 12 of the host vehicle 10 and an external service provider, such as the base station 18. Specifically, in the present invention, the roadside unit 16 is configured and arranged to establish a link between the vehicle on-board units 12 of the host vehicles 10 and the base station 18. An example is shown in FIG. 3 in which the vehicle on-board unit 12 of the host vehicle 10 establishes a link to the base station 18 via the roadside unit 16 in close proximity to the host vehicle 10. The base station 18 is, for example, a telecommunications provider or a service provider such as the vehicle's manufacturer. Since roadside units are known in the art, the structures of the roadside units 16 will not be discussed or illustrated in detail herein. Rather, it will be apparent to those skilled in the art from this disclosure that the roadside unit can be any type of structure that can be used to carry out the present invention.

The control unit 20 also preferably includes a microprocessor and other conventional components such as an input interface circuit, an output interface circuit, and storage devices such as a ROM (Read Only Memory) device and a RAM (Random Access Memory) device. The memory circuit stores processing results and control programs such as ones for operation of the two-way wireless communication system 21, the human-machine interface section 22, the global positioning system 23, the map database and storage section 25 as well as other vehicle components. Thus, the control unit 20 is capable of selectively controlling and/or monitoring all of the DSRC components of the host vehicle 10 such as the various safety systems and non-safety systems as needed and/or desired. It will be apparent to those skilled in the art from this disclosure that the precise structure and algorithms for the control unit 20 can be any combination of hardware and software that will carry out the functions of the present invention.

Thus, the control unit 20 together with the vehicle sensors (detection devices) function as a vehicle probe data collecting section configured to collect host vehicle probe data relating to external traveling conditions using the various vehicle sensors and/or other data communicated to the control unit 20 from other vehicles via the two-way wireless communication system 21. Preferably, the detection devices or sensors of the vehicle probe data collecting section further detect the external traveling conditions of the host vehicle that include of traffic, weather and roadway conditions.

The two-way wireless communication system 21 preferably includes communication interface circuitry that connects and exchanges information with other ones of the vehicles 10 that are similarly equipped as well as with the roadside units 16 through a wireless network within the broadcast range of the host vehicle 10. The two-way wireless communication system 21 is preferably configured and arranged to conduct direct two-way communications between vehicles (vehicle-to-vehicle communications) and roadside units (roadside-to-vehicle communications). Moreover, the two-way wireless communication system 21 is preferably configured to periodically broadcast a signal with the so called common message set in the broadcast area. The so called common message set can be broadcasted in three different way, i.e., (1) event based broadcasting, (2) periodic broadcasting and (3) hybrid (event based/periodic) broadcasting.

Thus, the two-way wireless communication system 21 acts as a two-way wireless communications section that is configured to receive the incoming common message sets from neighboring (preceding and following) vehicles. In connection with the present invention, the two-way wireless communication system 21 together with the control unit 20 function as a vehicle communication section that is configured to receive surrounding vehicle probe data, configured to disassociate identifying information from the surrounding vehicle probe data, and configured to selectively transmit the surrounding vehicle probe data without identifying information of the surrounding vehicle to an external communication device. The vehicle communication section is further configured to erase the surrounding vehicle probe data upon completing transmission of the surrounding vehicle probe data and when the vehicle onboard unit 12 is turned off (e.g., when the ignition key is turned off). Also, the two-way wireless communication system 21 is configured to broadcast the common message set of the host vehicle.

More specifically, as seen in FIG. 2, the two-way wireless communication system 21 is an on-board unit that includes a host vehicle two way communication device 21A and one or more antennas 21B. As mentioned above, the two-way wireless communication system 21 can be any suitable two-way wireless system, e.g., DSRC cellular, Wimax, Wifi, etc. The two way communication device 21A is configured to at least conduct direct short range communications in a host vehicle broadcast area surrounding the host vehicle 10 via the antennas 21B. Preferably, the antennas 21B include both an omni-directional antenna and a multi-directional antenna. In one preferred embodiment, the two-way wireless communication system 21 is a dedicated short range communication (DSRC) system, since the latency time between communications is very low compared to most other technologies that are currently available. However, other two-way wireless communication systems can be used if they are capable of conducting both point-to-point wireless communications and broadcast wireless messages in a limited broadcast area so long as the latency time between communications is short enough to carry out the present invention. When the two-way wireless communication system 21 is a DSRC system, the two-way wireless communication system 21 will transmit at a 75 Mhz spectrum in a 5.9 GHz band with a data rate of 1 to 27 Mbps, and a maximum range of about 1,000 meters. Preferably, the two-way wireless communication system 21 includes seven (7) non-overlapping channels. The two-way wireless communication system 21 will be assigned a Medium Access Control (MAC) address and/or an IP address so that each vehicle in the network can be individually identified. Thus, the two-way wireless communication system 21 is preferably DSRC that is used to transmit and receive a variety of message traffic to and from other DSRC devices (other OBUs and RSUs). Among the message types and applications supported by this process are vehicle safety messages and vehicle's dynamics.

The global positioning system 23 is a conventional global positioning system (GPS) that is configured and arranged to receive global positioning information of the host vehicle 10 in a conventional manner. Basically, the GPS unit 23A is a receiver for receiving a signal from the global positioning satellite 14 (FIG. 1) via the GPS antenna 23B. The signal transmitted from the global positioning satellite 14 is received at regular intervals (e.g. one second) to detect the present position of the host vehicle 10. The GPS unit 23A preferably has an accuracy of indicting the actual vehicle position within a few meters or less. This data (present position of the host vehicle) is fed to the control unit 20 for processing.

Figure 5:
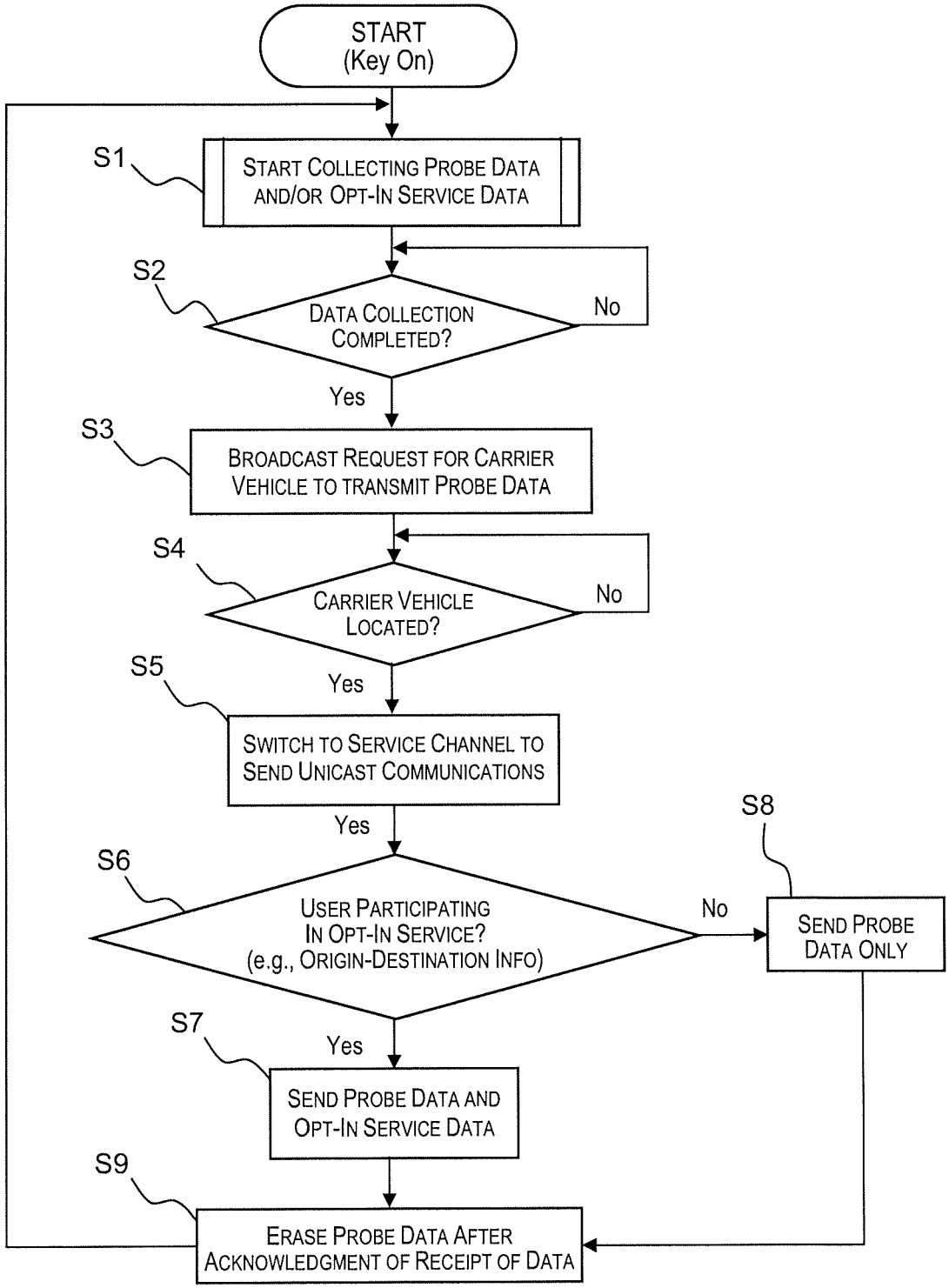
FIG. 5 is a flowchart illustrating a flow of control executed in the on-board unit of the host vehicle in order to transmit vehicle probe data and/or an Opt-In service data (e.g., travel route data) to a nearby or surrounding vehicle that is acting as a carrier vehicle in accordance with the present invention.

Referring now to the flowchart of FIG. 5, a simplified flow chart is illustrated to explain the basic functions that are performed in the vehicle on-board unit 12 to record and send probe information to a carrier vehicle. Of course, it will be apparent to those skilled in the art from this disclosure that other options, can be provided to the user in addition to the ones described and illustrated in the embodiment being used to illustrate the basic functions of the present invention.

When the user first turns on the vehicle, the vehicle on-board unit 12 is activated. In step S1, the control unit 20 starts collecting various data from its sensors, e.g., the current location of the host vehicle 10 via the global positioning system 23. Also in step S1, the vehicle on-board unit 12 immediately activates the two-way wireless communication system 21 to start listening for incoming messages. In particular, the control unit 20 processes the incoming messages received by the two-way wireless communication system 21 from other vehicles 10 and the roadside units 16 that are within the communication area. The information or data in theses incoming messages can be used in the probe data if needed and/or desired. Also theses incoming messages can include a set of instructions for the type of data to be collected.

In step S2, the control unit 20 determines if the data collection process has been completed. If the data collection process has been completed, then the process proceeds to step S3. If not, the control unit 20 continues collecting the data until the data collection process has been completed.

Next, in step S3, the two-way wireless communication system 21 of the host vehicle broadcasts a request for a carrier vehicle to retransmit (relay) its probe data to the roadside unit 16 after removing the MAC address and any other identifying information from its probe data.

In step S4, the two-way wireless communication system 21 of the host vehicle listens for a reply to its request for a carrier vehicle. Upon receiving a reply from a neighboring vehicle to its request for a carrier vehicle, the control unit 20 of the host vehicle proceeds to step S5.

Now, in step S5, the control unit 20 of the host vehicle switches to a service channel for establishing unicast communications with the carrier vehicle to send the probe data. Once unicast communications have been established between the host vehicle and the carrier vehicle, the control unit 20 of the host vehicle proceeds to step S6.

In step S6, the control unit 20 of the host vehicle determines if any other data that is not part of the required information of the probe data should also be sent to the carrier vehicle. In other words, for example, the control unit 20 of the host vehicle determines if the user of the host vehicle is participating in an optional service that collects data that may not be included in the probe data. One such optional service can be an Origin-Destination Service that collects and compiles various traveling time data. For example, the Origin-Destination Service collects and compiles travel times relating to the time it takes to travel a road segment at a particular time and/or day. Thus, origin data and destination data can be sent with the probe data if the user of the host vehicle has selected to participate in the optional service (step S7).

If the user of the host vehicle has selected not to participate in any optional services, then the control unit 20 of the host vehicle proceeds to step S8 and only sends the probe data to the carrier vehicle. Once the probe data has been sent in either step S7 or step S8, the control unit 20 of the host vehicle erases at least the probe data (preferably both the probe data and the optional service data) from its memory, and returns back to step S1 to start the process over again.

Figure 6:
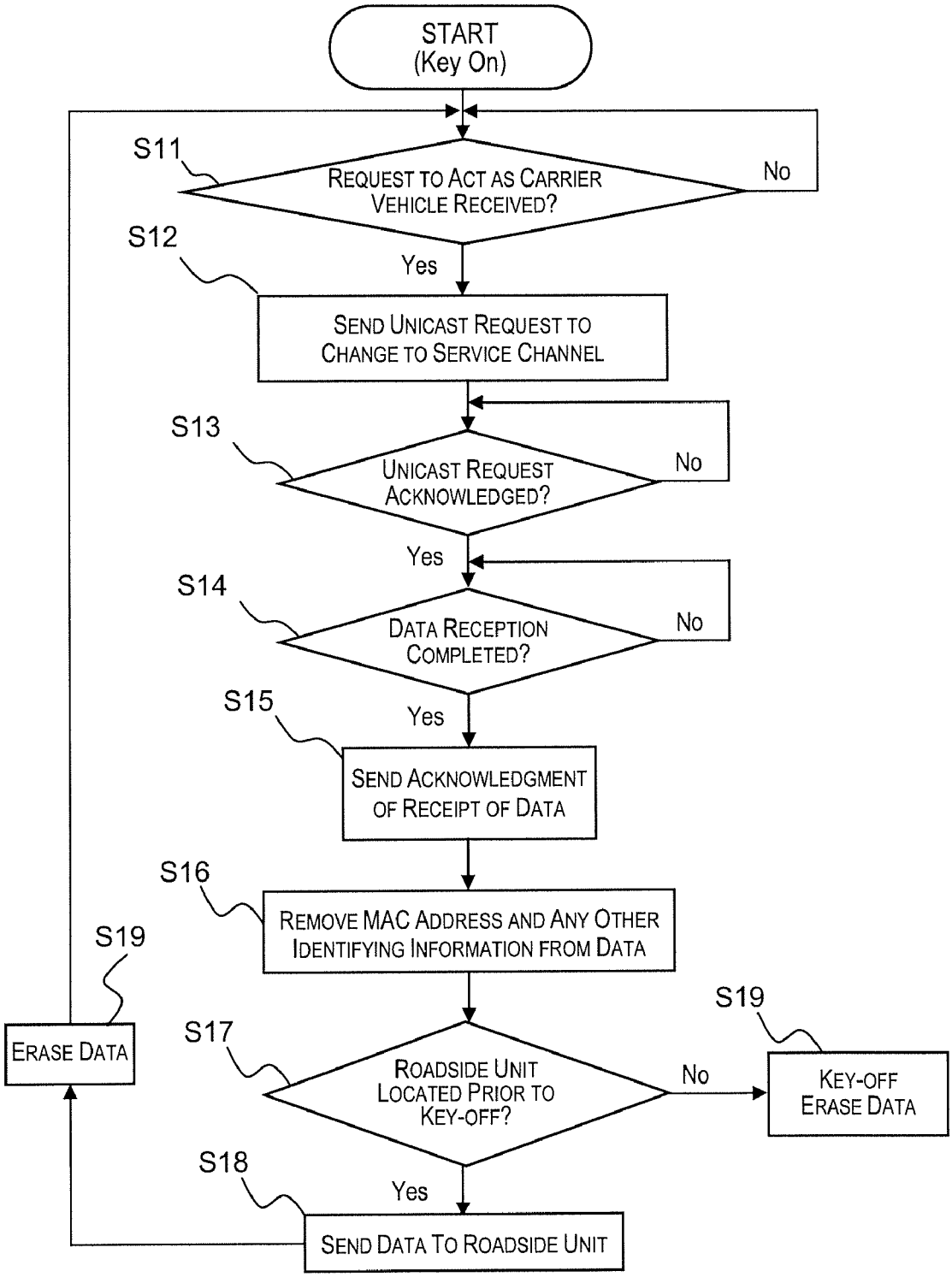
FIG. 6 is a flowchart illustrating a flow of control executed in the on-board unit of the host vehicle when the host vehicle is acting as a carrier vehicle to transmit vehicle probe data and/or an Opt-In service data (e.g., travel route data) to an external communication device (e.g., roadside unit) in accordance with the present invention.

Referring now to the flowchart of FIG. 6, a simplified flow chart is illustrated to explain the basic functions that are performed in the vehicle on-board unit 12 when the host vehicle is acting as a carrier vehicle. Of course, it will be apparent to those skilled in the art from this disclosure that other options, can be provided to the user in addition to the ones described and illustrated in the embodiment being used to illustrate the basic functions of the present invention.

When the user first turns on the vehicle, the vehicle on-board unit 12 is activated. In step S111, the control unit 20 starts listening for incoming messages including a request to act as carrier vehicle. In particular, the control unit 20 processes the incoming messages received by the two-way wireless communication system 21 from other vehicles 10 that are within the communication area to determine if it would be a suitable carrier vehicle. Once a request to act as a carrier vehicle has been received by the two-way wireless communication system 21 and the control unit 20 of the host vehicle (acting as the carrier vehicle) determine it would be a suitable carrier vehicle, the control unit 20 of the host vehicle (acting as the carrier vehicle) proceeds to step S12.

In step S12, the two-way wireless communication system 21 sends a request to the surrounding probe vehicle, which is requesting for a carrier vehicle, to switch to a service channel to establish unicast communications therebetween.

In step S13, the control unit 20 of the host vehicle (acting as the carrier vehicle) determines if the surrounding probe vehicle has acknowledged its request to switch to a service channel to establish unicast communications. Once the control unit 20 of the host vehicle (acting as the carrier vehicle) receives the acknowledgment from the surrounding probe vehicle, the control unit 20 of the host vehicle (acting as the carrier vehicle) proceeds to step S14.

In step S14, the control unit 20 of the host vehicle (acting as the carrier vehicle) monitors the process of the uploading of the probe data from the surrounding probe vehicle. Once the control unit 20 of the host vehicle (acting as the carrier vehicle) determines that the uploading of the probe data from the surrounding probe vehicle has been completed, the control unit 20 of the host vehicle (acting as the carrier vehicle) proceeds to step S15, where the two-way wireless communication system 21 the host vehicle (acting as the carrier vehicle) sends an acknowledgment of the receipt of the data.

Next, in step S16, the control unit 20 of the host vehicle (acting as the carrier vehicle) removes the MAC address and any other identifying information from data that was received from the surrounding probe vehicle. Then the control unit 20 of the host vehicle (acting as the carrier vehicle) prepares the data for retransmission in which its MAC address will be transmitted with the data that was received from the surrounding probe vehicle.

In step 17, the two-way wireless communication system 21 of the host vehicle (acting as the carrier vehicle) starts the process of locating the roadside unit 16 for retransmitting the data that was received from the surrounding probe vehicle with its MAC address. If a roadside unit is located before the host vehicle (acting as the carrier vehicle) is turned off, then the data that was received from the surrounding probe vehicle will be sent to the roadside unit 16 (step S18). After the data has been sent to the roadside unit 16, the surrounding probe vehicle will be erased (step S19)

However, in step S17, if no the roadside unit can be located before the host vehicle (acting as the carrier vehicle) is turned off, then the data that was received from the surrounding probe vehicle will be erased upon turning the ignition key to the "off" position (step S20).

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment(s), the following directional terms "forward, rearward, above, downward, vertical, horizontal, below and transverse" as well as any other similar directional terms refer to those directions of a vehicle equipped with the present invention. Accordingly, these terms, as utilized to describe the present invention should be interpreted relative to a vehicle equipped with the present invention. The term "detect" as used herein to describe an operation or function carried out by a component, a section, a device or the like includes a component, a section, a device or the like that does not require physical detection, but rather includes determining, measuring, modeling, predicting or computing or the like to carry out the operation or function. The term "configured" as used herein to describe a component, section or part of a device includes hardware and/or software that is constructed and/or programmed to carry out the desired function. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A vehicle information communication method comprising:

collecting at least one of host vehicle probe data and surrounding vehicle probe data in a host vehicle;

preparing at least one of a host vehicle common message set by associating the host vehicle probe data with host vehicle identifying information and a surrounding vehicle common message set associating the surrounding vehicle probe data with surrounding vehicle identifying information;

transmitting the at least one of the host vehicle common message set and the surrounding vehicle common message set from the host vehicle to a carrier vehicle;

disassociating the host vehicle identifying information from the host vehicle common message set in response to the host vehicle common message set being prepared and transmitted and disassociating the surrounding vehicle identifying information from the surrounding vehicle common message set in response to the surrounding vehicle common message set being prepared and transmitted, the disassociating occurring after transmission from the host vehicle; and transmitting the at least one of the host vehicle probe data and the surrounding vehicle probe data from the carrier vehicle after disassociating at least one corresponding identifying information of the host vehicle identifying information and the surrounding vehicle identifying information from the at least one of the host vehicle common message set and the surrounding vehicle common message set to an external communication device when the carrier vehicle is within a communication area of the external communication device, the disassociating of the at least one corresponding identifying information from the at least one of the host vehicle common message set and the surrounding vehicle common message set further including replacing the at least one corresponding identifying information with carrier vehicle identifying information.

2. The vehicle information communication method as recited in claim 1, further comprising erasing the at least one of the host vehicle common message set and the surrounding vehicle common message set automatically from the host vehicle upon completing transmission to the carrier vehicle.

3. The vehicle information communication method as recited in claim 1, further comprising erasing the at least one of the host vehicle common message set and the surrounding vehicle common message set automatically from the carrier vehicle upon completing transmission to the external communication device.

4. The vehicle information communication method as recited in claim 1, further comprising erasing the at least one of the host vehicle common message set and the surrounding vehicle common message set automatically from the host vehicle in response to the host vehicle being turned off.

5. The vehicle information communication method as recited in claim 1, further comprising erasing the at least one of the host vehicle common message set and the surrounding vehicle common message set automatically from the carrier vehicle in response to the carrier vehicle being turned off.

6. The vehicle information communication method as recited in claim 1, further comprising broadcasting a carrier request signal from the host vehicle to the carrier vehicle requesting the carrier vehicle to relay the at least one of the host vehicle common message set and the surrounding vehicle common message set to the external communication device;

sending a service channel change request from the carrier vehicle to the host vehicle upon receiving the carrier request signal from the host vehicle; and switching to a service channel in the host vehicle upon receiving the service channel change request from the carrier vehicle, with the transmitting of the at least one of the host vehicle common message set and the surrounding vehicle common message set to the carrier vehicle occurring via the service channel after the host vehicle has switched to the service channel.

7. The vehicle information communication method as recited in claim 1, further comprising sending a data received acknowledgement signal from the carrier vehicle to the host vehicle upon receipt of the at least one of the host vehicle common message set and the surrounding vehicle common message set.

8. The vehicle information communication method as recited in claim 7, further comprising erasing the at least one of the host vehicle common message set and the surrounding vehicle common message set from the host vehicle upon receipt of the data received acknowledgement signal.

9. The vehicle information communication method as recited in claim 1, further comprising collecting additional optional data from an optional information service to which a user of the host vehicle subscribes;

transmitting the additional optional data together with the at least one of the host vehicle common message set and the surrounding vehicle common message set from the host vehicle to the carrier vehicle;

disassociating identifying information from the additional optional data in response to transmission from the host vehicle; and transmitting the additional optional data together with the at least one of the host vehicle probe data and the surrounding vehicle probe data from the carrier vehicle after disassociating the identifying information to the external communication device.

10. The vehicle information communication method as recited in claim 9, wherein the collecting of additional optional data includes collecting at least one of origin data, destination data, and traveling time data with respect to the host vehicle.

11. The vehicle information communication method as recited in claim 1, wherein the transmitting of the at least one of the host vehicle common message set and the surrounding vehicle common message set further includes transmitting the at least one of the host vehicle common message set and the surrounding vehicle common message set to a plurality of carrier vehicles including the carrier vehicle via a plurality of transmissions from the host vehicle, the disassociating of the corresponding identifying information occurring after each of the plurality of transmissions.

12. The vehicle information communication method as recited in claim 1, wherein the host vehicle probe data and the surrounding vehicle probe data are non-safety data used in non-safety applications.

13. A vehicle information communication method comprising:

collecting host vehicle probe data in a host vehicle;

preparing a host vehicle common message set by associating the host vehicle probe data with host vehicle identifying information;

establishing a service channel communication link between the host vehicle and a carrier vehicle;

transmitting the host vehicle common message set from the host vehicle to the carrier vehicle via the service channel communication link after the service channel communication link has been established between the host vehicle and the carrier vehicle;

disassociating the host vehicle identifying information from the host vehicle common message set in response to transmission from the host vehicle;

transmitting the host vehicle probe data from the carrier vehicle after disassociating the host vehicle identifying information from the host vehicle common message set to an external communication device when the carrier vehicle is within a communication area of the communication device; and erasing the host vehicle common message set from the host vehicle upon receipt of a data received acknowledgement signal from the carrier vehicle.

14. The vehicle information communication method as recited in claim 13, further comprising collecting surrounding vehicle probe data in the host vehicle;

preparing a surrounding vehicle common message set by associating the surrounding vehicle probe data with surrounding vehicle identifying information;

transmitting the surrounding vehicle common message set from the host vehicle to the carrier vehicle;

disassociating the surrounding vehicle identifying information from the surrounding vehicle common message set in response to transmission from the host vehicle; and transmitting the surrounding vehicle probe data from the carrier vehicle after disassociating the surrounding vehicle identifying information from the surrounding vehicle common message set to the external communication device when the carrier vehicle is within the communication area of the communication device.

15. The vehicle information communication method as recited in claim 14, further comprising erasing the host vehicle common message set and the surrounding vehicle common message set automatically from the host vehicle in response to at least one of completing transmission to the carrier vehicle and the host vehicle being turned off

16. The vehicle information communication method as recited in claim 14, further comprising erasing the host vehicle common message set and the surrounding vehicle common message set automatically from the carrier vehicle in response to at least one of completing transmission to the external communication device and the carrier vehicle being turned off.

17. The vehicle information communication method as recited in claim 13, wherein the establishing of the service channel communication link includes broadcasting a carrier request signal from the host vehicle to the carrier vehicle requesting the carrier vehicle to relay the host vehicle common message set to the external communication device, sending a service channel change request from the carrier vehicle to the host vehicle upon receiving the carrier request signal from the host vehicle, and switching to a service channel in the host vehicle upon receiving the service channel change request from the carrier vehicle.

18. The vehicle information communication method as recited in claim 13, wherein the transmitting of the host vehicle common message set further includes transmitting the host vehicle common message set to a plurality of carrier vehicles including the carrier vehicle via a plurality of transmissions from the host vehicle, the disassociating of the host vehicle identifying information occurring after each of the plurality of transmissions.

19. The vehicle information communication method as recited in claim 13, wherein the disassociating of the host vehicle identifying information from the host vehicle common message set further includes replacing the host vehicle identifying information with carrier vehicle identifying information.

20. The vehicle information communication method as recited in claim 13, wherein the host vehicle probe data are non-safety data used in non-safety applications.

21. A vehicle information communication method comprising:

collecting surrounding vehicle probe data in a host vehicle;

preparing a surrounding vehicle common message set by associating the surrounding vehicle probe data with surrounding vehicle identifying information;

establishing a service channel communication link between the host vehicle and a carrier vehicle;

transmitting the surrounding vehicle common message set from the host vehicle to the carrier vehicle via the service channel communication link after the service channel communication link has been established between the host vehicle and the carrier vehicle;

disassociating the surrounding vehicle identifying information from the surrounding vehicle common message set in response to transmission from the host vehicle;

transmitting the surrounding vehicle probe data from the carrier vehicle after disassociating the surrounding vehicle identifying information from the surrounding vehicle common message set to an external communication device when the carrier vehicle is within a communication area of the communication device; and erasing the surrounding vehicle common message set from the host vehicle upon receipt of a data received acknowledgement signal from the carrier vehicle.

22. The vehicle information communication method as recited in claim 21, further comprising collecting host vehicle probe data in the host vehicle;

preparing a host vehicle common message set by associating the host vehicle probe data with host vehicle identifying information;

transmitting the host vehicle common message set from the host vehicle to the carrier vehicle;

disassociating the host vehicle identifying information from the host vehicle common message set in response to transmission from the host vehicle; and transmitting the host vehicle probe data from the carrier vehicle after disassociating the host vehicle identifying information from the host vehicle common message set to the external communication device when the carrier vehicle is within the communication area of the communication device.

23. The vehicle information communication method as recited in claim 22, further comprising erasing the host vehicle common message set and the surrounding vehicle common message set automatically from the host vehicle in response to at least one of completing transmission to the carrier vehicle and the host vehicle being turned off.

24. The vehicle information communication method as recited in claim 22, further comprising erasing the host vehicle common message set and the surrounding vehicle conunon message set automatically from the carrier vehicle in response to at least one of completing transmission to the external communication device and the carrier vehicle being turned off.

25. The vehicle information communication method as recited in claim 21, wherein the establishing of the service channel communication link includes broadcasting a carrier request signal from the host vehicle to the carrier vehicle requesting the carrier vehicle to relay the surrounding vehicle common message set to the external communication device, sending a service channel change request from the carrier vehicle to the host vehicle upon receiving the carrier request signal from the host vehicle , and switching to a service channel in the host vehicle upon receiving the service channel change request from the carrier vehicle.

26. The vehicle information communication method as recited in claim 21, wherein the transmitting of the surrounding vehicle common message set further includes transmitting the surrounding vehicle common message set to a plurality of carrier vehicles including the carrier vehicle via a plurality of transmissions from the host vehicle, the disassociating of the surrounding vehicle identifying information occurring after each of the plurality of transmissions.

27. The vehicle information communication method as recited in claim 21, wherein the disassociating of the surrounding vehicle identifying information from the surrounding vehicle common message set further includes replacing the surrounding vehicle identifying information with carrier vehicle identifying information.

28. The vehicle information communication method as recited in claim 21, wherein the surrounding vehicle probe data are non-safety data used in non-safety applications.

* * * * *